United States Patent [19]

Eickmann

[11] Patent Number: 4,685,381

[45] Date of Patent: Aug. 11, 1987

[54] PIVOT PORTION OF A PISTON SHOE IN FLUID MACHINES

[76] Inventor: Karl Eickmann, 2420 Isshiki, Hayama-machi, Kanagawa-ken, Japan

[21] Appl. No.: 778,041

[22] Filed: Sep. 20, 1985

Related U.S. Application Data

[60] Continuation-in-part of Ser. No. 575,623, Jan. 31, 1984, abandoned, which is a continuation-in-part of Ser. No. 228,634, Jan. 26, 1981, abandoned, which is a division of Ser. No. 911,246, May 31, 1978, abandoned.

[51] Int. Cl.[4] ..... F01B 13/06

[52] U.S. Cl. ..... 91/488; 92/58; 92/157

[58] Field of Search ..... 91/488, 491, 497; 92/58, 157, 158

[56] References Cited

FOREIGN PATENT DOCUMENTS

| | | | |
|---|---|---|---|
| 1439352 | 6/1976 | United Kingdom | 91/488 |
| 584091 | 12/1977 | U.S.S.R. | 91/488 |
| 649878 | 2/1979 | U.S.S.R. | 91/488 |

*Primary Examiner*—Leonard E. Smith
*Assistant Examiner*—Paul F. Neils

[57] ABSTRACT

In a pivot bar portion of a piston shoe in a radial piston device wherein the pivot portion is pivotably borne in a bed in the piston which extends normal to the longitudinal axis of the piston, recesses are provided parallel to the pivot axis whereby bearing lands are formed between the recesses. The bearing lands are tracting fluid out of the recesses along themselves and the bearing bed face of the piston, when the shoes pivot in the piston. A perfectly operational forced lubrication between the pivot portion and the piston is thereby assured which results in a long life and very high bearing capacity between the piston and the piston shoe.

10 Claims, 19 Drawing Figures

PIVOT PORTION OF A PISTON SHOE IN FLUID MACHINES

REFERENCE TO RELATED APPLICATIONS

This is a continuation in part application of my application Ser. No. 575,623, now abandoned, which was filed on Jan. 31, 1984 as a continuation-in-part application, Ser. No. 228,634, now abandoned, which was filed on Jan. 26, 1981. Application Ser. No. 228,634 was a divisional application of my elder application Ser. No. 911,246 which was filed on May 31, 1978. Benfit of this elder application is hereby claimed. FIGS. 1 to 3 are true copies of FIGS. 33 to 34 of the mentioned elder application and the elder application Ser. No. 911,246 is now abandoned.

BACKGROUND OF THE INVENTION

1. Field of the Invention

This invention relates partially to hydrostatic bearings of the kind, where an at least partially cylindrically formed body pivots or revolves on an at least partially hollow-cylindrical face of complementary configuration and size of a bearing body and where fluid under pressure is forced into the pivot or rotary bearing between the two bodies. In particularly the present invention is applied in the piston and piston shoe assembly of a radial piston machine, where the piston shoe pivots on a bed of the piston.

2. Description of the Prior Art

Typical radial piston machines, where a piston shoe pivots with a pivot portion in a bearing bed of a piston, are shown for example in my elder U.S. Pat. Nos. 3,223,046 and 3,277,834 while improvements of the pivot bearing between the piston and shoe are provided in my patent applications Ser. No. 802,231, now U.S. Pat. No. 4,206,690 or application Ser. No. 790,822, filed on Apr. 25, 1977, now abandoned but continued in application Ser. No. 121,356, which was filed on Feb. 14, 1980, now U.S. Pat. No. 4,452,127, issued on June 5, 1984. Similarly improved pivot bearings are also shown in my U.S. Pat. No. 4,479,420 which issed on Oct. 30, 1984.

The prior art of my patents and applications, which are here mentioned, already had a fluid pressure pocket in the pivot bar of the piston shoe. The fluid pressure pocket was however either a single concentrically located recess or plural recesses cut substantially in the direction of pivotion. For medial pressures the arrangments of the prior art have worked excellently. However, in presently used radial piston devices the pressures are increasing. Therefore, the pivot arrangements of the former art are not capable enough any more to handle the higher pressures. This is specially the case, because the sealing or bearing lands remain unlubricated, because they are side wards of the fluid pressure pockets. The high load at high pressure in the machine presses the fluid away from the bearing lands, whereby they are running dry, fail to lubricate and weld under extreme high pressures in the radial piston machine.

Other prior art is shown in many other patents, which are no Eickmann patents, and such other prior art errs by failing to recognize that the respective pivot bearings are overloaded bearings. The recesses applied in such other formed art fail to act as it was assumed that they would act.

SUMMARY OF THE INVENTION

The major aim and object of the invention is to overcome the difficulties of the mentioned prior art. It is therefore the aim and object of the invention to make the piston-piston shoe arrangement capable for higher radial pressures in the machine. Especially the object of the invention is to secure that the sealing lands or bearing lands are lubricated and remain lubricated at the slow speed motion between relative to each other moving faces, where all common hydrodynamic lubrication and bearing effects fail because of the low relative movement speed between the faces. For example between the face of the bearing bed of the piston and of the pivot face of the pivot bar portion of the piston shoe.

The details of the objects and aims of the invention and the arrangements to obtain the desired objects and aims of the invention, are more in detail, for example, to provide:

1. An assembly of a first body, for example, a piston and a thereon pivotable second body, for example, a portion of a piston shoe or a piston shoe, wherein the first body has a first axis longitudinal through said first body, a part-cylindrical bearing bed face of substantially the form of about half of a hollow cylinder and formed with a first radius around a second axis which is normal to said first axis and extending through said first axis, a passage is extending through said first body and through said bearing bed face while said passage is communicated to a space under high pressure in fluid, wherein said second body includes a pivot portion having a pivot face complementary formed to said bearing bed face and at least 180 degrees with a second radius around a third axis, wherein said first and second radii are substantially equal and said pivot portion is borne with its pivot face on said bearing bed face and able to pivot thereon around said second and third axes while at said bearing of said pivot portion on said bearing bed face of said first body said third axis coincides substantially with said second axis, wherein said first body and second body are pressed towards each other by substantially oppositionally directed forces and said faces are at least partially lubricated by said fluid whereto said bearing bed face is communicated by said passage, wherein a plurality of recesses are provided into portions of one of said faces, said recesses are communicated to said passage and filled with fluid under pressure when said space whereto said passage is communicated contains fluid under pressure, and, wherein said recesses have a narrow width but a greater length and said recesses are extending with their lengths in a direction parallel to said second and third axes whereby the remainders of said pivot face between said recesses form bearing lands between said recesses which extend parallel to said recesses and said second and third axes;

or;

2. The assembly of 1, wherein the bearing lands and the bearing bed face are lubricated by the fluid from the recesses, the breadth of the bearing lands is less than five millimeters, the recesses are closed on their longitudinal ends by pivot face portions of less than five millimeters in length in the direction parallel to the second and third axes, whereby the bodies obtaine an ability to pivot under high loads relative to each other, while the bearing lands tract fluid from the recesses along themselves and portions of the bearing bed face, when the second body pivots relative to the first body.

or;

3. The assembly of 2, wherein the first body is the piston, the second body is the piston shoe and the space is the cylinder of a radial piston machine, wherein fluid flows through the cylinders of the machine and the piston shows pivot relative to the pistons when the machine works under power.

or;

4. The assembly of 3, wherein the pivot portion of the piston shoe has part cylindrical ends which are distanced from each other with a distance which is slightly less than the outer face diameter of the respective piston and wherein one of the bearing lands is provided in the middle of the bottom of the pivot portion of the piston shoe equally dimensioned along the vertical medial plane through the piston shoe and the recesses are symmetrically arranged around the medial vertical plane through the piston shoe.

The above portion of the summary of the invention shows the state of the art as it existed during the filing of the parental application during early 1980. In the meanwhile still more deeper inquiries were done by the inventor of the present patent application.

These inquiries discovered, that there are very different situations on the slide faces of piston shoes compared to the pivot portions of piston shoes. True is, that what is good for the slide faces is bad for the pivot portion.

In the slide faces of piston shoes or of bodies which slide along a face under a load the provision of fluid pressure pockets provides a bearing which carries the major portion of the load. Provided that the area of the slide face with the fluid pressure pocket therein is large enough. That is the case in radial piston devices with slide faces of piston shoes. The former art as well as applicant's original application and many other patents have assumed, that the fluid pressure pockets could also be provided in the pivot portions of piston shoes of radial piston devices and that they would obtain a similar effect and function there. Partially that was also obtained in the above described summary of the invention.

The now deeper discoveries however find, that such fluid pressure pockets in pivot portions of piston shoes of radial piston devices need further modifications to obtain a better success. Especially, it has now been found, that fluid pressure pockets in pivot portions of piston shoes have negative effects, if their cross-sectional areas are too large or if they are wrongly directed and placed.

The invention now recognizes that in the radial piston machine with a piston shoe borne in a bed of the piston to pivot therein in the entire cross-sectional area of the piston is subjected to the pressure in the fluid in the cylinder. The bearing face area of the pivot portion of the piston shoe is, however, smaller than the cross-sectional area of the piston. Consequently, the present invention discovers, that each recess or fluid pressure pocket in the pivot bed of the piston or in the pivot face of the piston shoe reduces the bearing face area of the pivotal movement under the load. The load on the bearing face portions becomes as higher as bigger the cross-sectional area of the sum of the fluid pressure pockets in the pivot arrangement is. Large fluid pressure pockets in the pivot arrangement will, therefore, lead to heavy overload of the faces which carry the load during the pivotal movement.

In accordance with the newest discoveries of the present invention, it is, therefore, required for high pressures in fluid to replace the heretofore used fluid pressure pockets in pivot portions of radial piston devices by very narrow recesses directed normal to the direction of the pivotal movement. Thereby force - lubricated bearing lands of high bearing capability are created and they are less loaded than the former smaller bearing lands.

DESCRIPTION OF THE PREFERRED EMBODIMENT

Pivot-bars or trunnions of piston shoes had heretofore according to my earlier patent appliation Ser. No. 802,231; now U.S. Pat. No. 4,206,690; fluid pressure pockets substantially normal to the pivot-axis of the cylindrical or part-cylindrical pivot-bar. That results at very high pressures in a wearoff at the faces between piston and pivot-bar. Because the faces meet allways at the same places.

Figure 3:
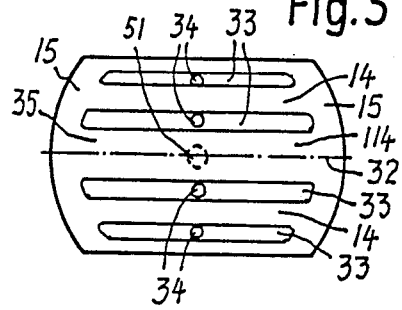
FIG. 3 is a view onto the portion of FIG. 2 seen along the arrow III.
Figure 1:
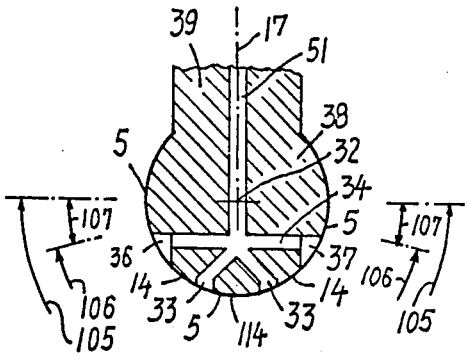
FIG. 1 is a cross-sectional view of a pivot portion of the invention.
Figure 2:
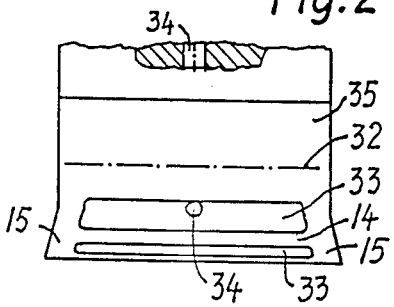
FIG. 2 is a view onto the portion of FIG. 1 seen along the arrow II.

Such wear is prevented by the embodiment of FIGS. 1 to 3 of the invention. Piston shoe - neck 39 extends from the pivot bar 38. Passage 34 has equal purposes as in the other respective Figures of the prior art.

According to this embodiment of the invention, however, the fluid pressure pockets 33 are now elongated in the direction parallel to the pivot axis 32 of pivot bar 38. Thereby they are now normal to the direction of the pivotal movement of the piston shoe. Consequently, the face portions 14,114 between the recesses or fluid pressure pockets 33 now periodically meet other portions of the face of the piston bed 6 wherein the pivot-bar 38 is pivotably borne. The earlier local wear of face portions of designs of the former art is thereby reduced or prevented. The pockets 33 extend over almost the entire length of the pivot-bar in order to obtain the highest possible fluid pressure action in them. The supply of fluid under pressure into the pockets 33 can be done by communication passages 34, which communicate the pockets with the fluid pressure passages 51 and 12.

That is in short words the entire arrangement of the invention. To understand it, however, it should be noted, that the pressures in radial piston devices are now very high and may well exceed 5000 psi or even 10,000 psi. At such high pressures the piston shoe is very strongly pressed with its pivot portion against the bearing bed in the piston. It is not possible to enlarge the area of the pivot bearing, because the pivot portion of the piston shoe must remain within the cross-sectional area of the piston. Consequently the relative pressure per unit of area between the pivot face and the bearing bed becomes very high at such high pressures. The high pressures load squeezes the fluid film out of the respective pivot face bearing land and the respective portion of the bearing bed of the piston. These places are then running dry. Such action appeared in the arrangements of the prior art, where the fluid pressure pockets of recesses were provided in the direction of the movement of pivotion. The sidewards thereof located bearing lands then swung along non-lubricated portions of the bearing bed of the piston, where they run dry and welded.

It is therefore very important and, the only possible solution, to prevent the dry running and welding of the former art, by the arrangement of the invention, which is to move the bearing lands at the movement along the bearing face through bearing face areas which contained pressure fluid at the respective moments before the respective portion of the movement. This is possible only, as done in the present invention, namely by cutting or providing the recesses and bearing lands, or in other words, the fluid pressure pockets and the bearing lands therebetween in a direction normal to the pivotal movement. This direction normal to the pivotal movement is the direction parallel to the axis 4 thereof. This axis is also called the second axis which is the axis of the bearing bed 6 of the piston and the third axis 32 which is the medial axis 32 of the pivot portion 38 of the piston shoe bar. Both axes, the second and third coincide when the piston shoe pivot bar is inserted into the bearing bed of the piston.

Thus, we have the following geometrical means:

Piston 1 has the first axis 3 which is the longitudinal axis of the piston.

Piston 1 has the second axis 4 around which the bearing bed 6 is formed with radius 11.

Piston shoe 10 has a pivot portion 38 with the third axis 32 which coincides with the second axis 4, when the pivot portion 38 is inserted into the piston bed 6.

The pivot face 5 is formed with the radius 11 around the third axis 32 and is complementary to the face of the bearing bed 6 in the piston.

Figure 5:
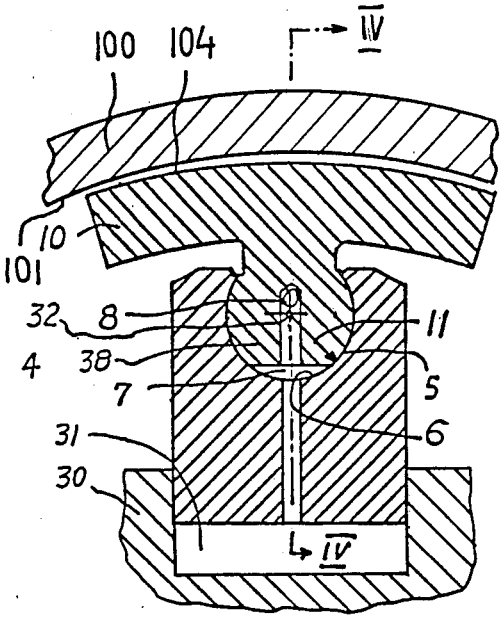
Fig. 5 PRIOR ART
FIG. 5 is a cross-sectional view through FIG. 4 along the line V—V.
Figure 4:
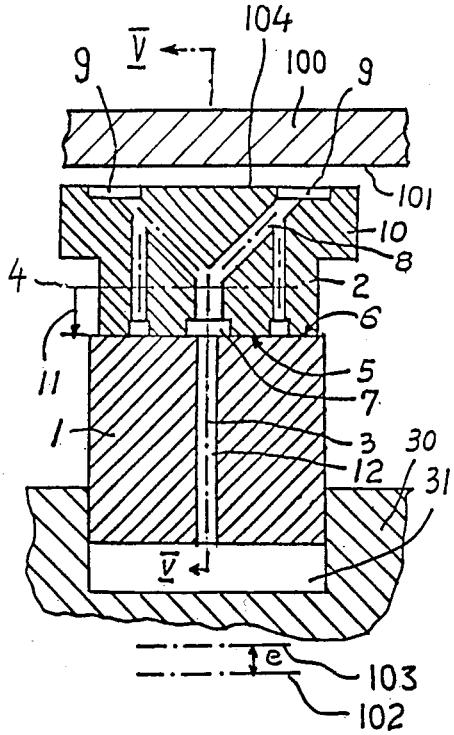
Fig. 4 PRIOR ART
FIG. 4 is a longitudinal sectional view through an assembly of the prior art.

The Figures of the fomrer art, namely FIGS. 4 and 5, show the passage 12 through the piston and passages 8 through the piston shoe, whereby the fluid pressure pockets or recesses 7, 33 are communicated. The respective passage through portions of the piston shoe are in FIGS. 1 to 3 of the invention to the passages 51 and 34. The passages commonly also communicate to balancing windows or fluid pressure pockets 9 in the outer face of the piston shoe.

The piston shoes of the former art of Eickmann as well as the piston shoes of the present invention, have guide portions 10 with slide faces thereon with which the piston shoes slide along the piston stroke guide face(s) of the piston stroke guide ring or actuator. Between the rotor, which contains the cylinders wherein the pistons reciprocate, and the stroke guide face(s) of the actuator is an eccentricity, defined by the axis of the rotor and the therefrom radially distanced axis of the stroke guide ring (actuator). The mentioned eccentricity defines the length of the piston stroke as 2 times "e" with "e" the distance between the mentioned axes of the rotor and actuator. The mentioned eccentricity also defines the pivotal movements of the piston shoes in the respective pistons.

It should be noted, that the recesses 33 now extend, longitudinally parallel to the third axis 32 and when assembled, also to the second axis 4. Between the recesses 33 remain the undisturbed pivot face portions 14, which now form the bearing lands 14, 114 between the recesses 33. These bearing land portions also extend parallel to the second and third axes. The recesses 33, thus, have a great length parallel to the second and third axes 32 and 4, but a small breadth perpendicular or normal thereto. The recesses 32 are closed on their longitudinal ends by seal portions 15 of undisturbed portions of the pivot face 5 of the pivot portion 38.

The recesses are provided exclusively in that portion of the pivot portion of the piston shoe, which is at all times of the pivotal movement of the pivot portion flanked and met by the bearing bed face 6 of the piston. Thereby it is secured that the recesses 33 are at all times closed at the pivotal movement of the pivot portion of the respective piston shoe. Since commonly the bearing bed face 6 forms a half of an inner face of a cylinder and thereby extends about 180 degrees angularly around the axis of the bearing bed 6, the mentioned recesses 33 are provided at an angular interval of less then 180 degrees minus the angle of pivotal movement and minus the angular size of the sealing lands around the axis of the pivot portion of the piston shoe.

Accordingly FIG. 1 shows the angle 105 as the angle of the bearing bed, the angle 106 as the angle in which the recesses and lands of the invention are to be applied and the angle 107 which is the portion which departs temporary at the pivotal movement from the bearing bed and which, consequently, should not be used to apply therein any recesses.

The technological basis of this arrangement is, that the relative speed of the movement between the pivot face 5 and the bearing bed face 6 are so small, that hydrodynamic effects can not develop between these faces. Especially also not, because the high thrust forces under the load between piston and piston shoe are higher than any possible hydrodynamic bearing power or force. Consequently, the classic hydrodynamic theory completely fails in such cases as in the arrangement here discussed.

It is therefore required in accordance with this invention, that the being lands 14, 114 between the recesses 33 are very short in the direction of movement and that they travel at each movement through areas of the bearing bed 6, which were lubricated by a fluid in a respective recess 33 immediately before the movement of the bearing land over the respective portion of the bearing bed face 6. The bearing lands 14, 114, end seal portions 15 of the recesses 33 should therefore be shorter than five millimeters, whereby the shortness of the bearing lands means the shortness in the direction of the movement, which is normal to the elongated direction of the bearing lands and of the recesses 33 of the invention. When the pressures become very high, the five millimeters must become reduced to 4,3,2 or less millimeters and a greater number of recesses 33 must then become set.

The arrangement of the invention is not only suitable for pivot portions of piston shoes, but also for bearings, where two faces move relative to each other under a very high relative load with small movement speed, irregardless of whether the movement is a revolution, a straight movement or a pivotal movement.

For defining the arrangement of the invention more in details and with terms, which are suitable for definitions, the description of the embodiment of the invention, may also be, as follows:

1. An assembly of a first body 1, for example, a piston 1 and a thereon pivotable second body 10,38, for example, a piston shoe. 10, 38 the first body has a first axis 3 longitudinal through said first body, a part-cylindrical bearing bed face 6 of substantially the form of about half of a hollow cylinder and formed with a first radius 11 around a second axis 4 which is normal to said first axis and extending through said first axis, a passage 12 extends through said first body and through said bearing bed face while said passage is communicated to a space 31 under high pressure in fluid , wherein said second body includes a pivot portion 38 having a pivot face 5 complementary formed to said bearing bed face 6 and with a second radius 11 around a third axis 32, wherein said first and second radii 11 are substantially equal and said pivot portion 38 is borne with its pivot face 5 on said bearing bed face 6 and able to pivot thereon around said second and third axes 4,32 while at said bearing of said pivot portion on said bearing bed face of said first body said third 32 coincides substantially with said second axis 4;

wherein said first body and second body are pressed towards each other by substantially oppositionally directed forces on said faces are at least partially lubricated by said fluid whereto said bearing bed face 6 is communicated by said passage 12; wherein a plurality of recesses 33 are provided into portions of one of said faces 5,6; said recesses 33 are communicated to said passage 12 and filled with fluid under pressure when said space 31 whereto said passage 12 is communicated, contains fluid under pressure, and, wherein said recesses 33 have a narrow width but a greater length and said recesses 33 extend with their lengths in a direction parallel to said second and third axes 4,32 whereby the remainders of said pivot face 5 between said recesses 33 form bearing lands 14,114 between said recesses 33 which extend parallel to said recesses and to said second and third axes 4,32.

2. The assembly of 1, wherein said bearing lands 14 and said bearing bed face 6 are lubricated by said fluid from said recesses 33, the breadth of said bearing lands is less than five millimeters, said recesses are closed on their longitudinal ends by pivot face portions 15 of less than five millimeters in length in the direction parallel to said second and third axes, whereby said bodies 1,10 obtain an ability to pivot under high loads relative to each other, while said bearing lands 14 tract fluid from said recesses 33 along themselves and portions of said bearing bed face 6 when said second body 10,38 pivots relative to said first body 1.

3. The assembly of 2, wherein said first body is the piston 1, said second body is the piston shoe 10 and said space is the cylinder 31 of a radial piston machine, wherein fluid flows through the cylinders of the machine and the pistons shoes pivot relative to the said pistons when the said machine works under power.

4. The assembly of 3, wherein said pivot portion of said piston shoe has part cylindrical ends which are distanced from each other with a distance which is slightly less than the outer face diameter of the respective piston and wherein one (114) of said bearing lands 14 is provided in the middle of the bottom of the pivot portion 38 of the piston shoe equally dimensioned along the vertical medial plane 17 through the piston shoe 10,38 and said recesses 33 are symmetrically arranged around said medial vertical plane 17 through said piston shoe 10, 38.

Referring now to the additional discoveries after the year of 1980, it will be seen from FIGS. 4 and 5, that the piston 1 is located in the cylinder 31 of a rotor 30 of the former art. Cylinder 31 contains the high pressure fluid. The highly pressurized fluid in cylinder 31 acts against the bottom of the piston 1. Thereby the entire cross-sectional area normal to the longitudinal axis 3 of the piston is subjected to the high pressure of the pressurized fluid in cylinder 31.

Figure 10:
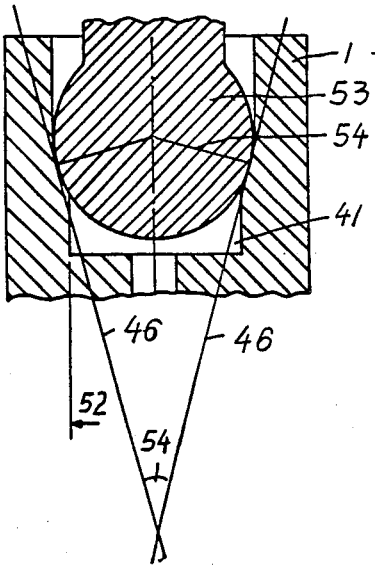
FIG. 10 is a cross-sectional view through a device.

FIG. 10 now demonstrates that the former art assumed, that it would be helpful to provide a fluid pressure pocket 51 of a diameter 52 in the piston 1. Such pocket is commonly called a "balancing" pocket. The origin of such balancing fluid pressure pockets can be traced back to applicant's patents of the end fifties for control bodies and vanes and to the early sixties for piston shoes of radial piston devices. See hereto, for example, applicant's U.S. Pat. Nos. 3,062,151 ; 3,186,347; 3,223,046 and others. Since that time the application of such fluid pressure balancing pockets to carry a load by the pressure in fluid in the balancing pockets became widely used. The relative on each other sliding faces were thereby also lubricated at the sealing lands around the fluid pressure pockets. The friction between the on each other sliding faces was reduced and due to the counter acting force of pressure in fluid in the fluid pressure balancing pockets the load on the on each other borne faces was reduced. This is especially true also for the slide faces of piston shoes as tought, for example by U.S. Pat. No. 3,223,046.

During the sixties and seventies a number of patents appear which all assume that a setting of a balancing pocket between the faces of the piston and shoe of radial piston devices would reduce the load, wear and friction between the adjacent faces of the pivot portion of the piston shoe and the bed of the piston whereon the pivot portion of the shoe is borne and pivots. Some of the so issued patents even teach that the bores or recesses might be provided accordingly to obtain the floating of the piston shoe portion in the piston bed or to balance it by pressure in fluid.

During the seventies the applicant has steadily improved the locations and dimensions of the recesses and bearing lands in the pivot arrangement of the radial piston and the shoe therein. See, for example, the patents which are mentioned under the reference to related applications.

All these attempts in the art, however, erred. Because they assumed that what is good in a slide face of a piston shoe would also be good in a pivot portion in a piston shoe in a piston. This, the present invention clearly discovers, is not true.

Figure 8:
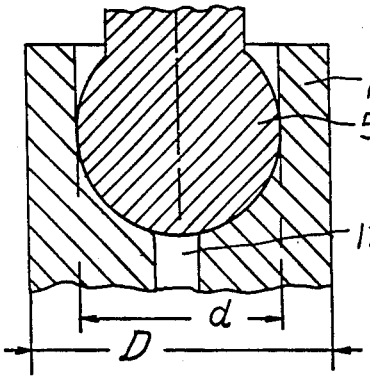
FIG. 8 is a cross-sectional view through a device.

FIG. 8 demonstrates this problem. The piston 1 has a spherical pivot bed face. It is in the form of a portion of a hollow ball. Passage 12 supplies pressurized fluid from the respective cylinder to the pivot arrangement. The piston is subjected to the load equal to the square of the outer diameter "D" multiplied by pi/4 and multiplied by the rate of pressure in fluid. Thererin "pi" is about 3.14 and the rate of pressure in fluid is the pressure per area, for example, kilograms per squarecentimeter. The diameter of the pivot portion 53 of the piston shoe is, however, only "d" and "d" is smaller than "D".

The former art provided a fluid pressure balancing pocket, as seen in FIG. 10 into the pivot arrangement of FIG. 8 or 10. The former art assumed, that this pocket would reduce the load and the friction during the pivotal movement of the piston shoe pivot portion 53 above pressure pocket 41 in piston 1. This assumption of the former art is the big error, which the present invention discovers and will overcome.

The error of the former art is, that the load on the bearing faces would become reduced by the provision of the pocket 41.

The discovery of the present invention is, that the load on the bearing faces of the pivot arrangement will not become reduced but will become incresed when the pocket 41 becomes applied. Additionally, the invention recognizes, that the load on the faces of the pivot arrangement of piston shoe portions in pistons will become more higher as bigger the diameter 52 of the pocket 41 will be. That is so because the diameter "D" is always bigger than the diameter "d" since the pivot portion is always located within the piston. Therefore, "d" can never be as big as "D" and must all times remain smaller than "D". That means that if, for example, the area of diameter "D" is 1.5 times of the area of diameter "d", the load on the pivot arrangement will be 1.5 times higher than the rate of pressure in the cylinder and on the bottom of the piston. Let, for example, the diameter of the pocket 41 be 90 percent of the diameter "d". The cross-sectional area of the pocket 41 will then be equal to the area of the diameter "d" divided by the square of 0.9 (ninety percent), namely 0.81 of the area "d". Thus, the pocket will carry the load on the diameter "D" divided by 1.5 and multiplied by 0.81=54 percent of the load which acts on the bottom of the piston. However, the area of the bearing faces has become reduced to 19 percent of the area of the diameter "d". These 19 percent of the area of diameter "d" are to be divided by 1.5 since the area of diameter "D" was assumed to be 1.5 times bigger than that of the diameter "d". Consequently 0.19 /1.5=12.6 percent area of faces have now to carry 46 percent of the load which acts onto the bottom of the piston. The remaining bearing faces between diameter "d" and 52 now have to carry 46 percent divided by 12.6 percent=3.66 times overload compared to the rate of pressure in the cylinder and below the bottom of the piston. On the other hand, the bearing faces between the pivot portion of the shoe and the piston would have been overloaded only 1.5 times, if no passage 12 and no pocket 51 would have been applied.

Thus, the present invention has proven that the provision of a fluid pressure pocket between the faces of the pivot arrangement in a piston will not reduce the specific load on the bearing faces but will, on the contrary, increase the specific and total load on the bearing faces of the pivot arrangement.

In actuality, however, not only will the load on the faces become increased when a fluid pressure pocket 41 is provided in the pivot arrangement of the piston shoe in the piston, but in addition thereto a binding-or welding effect will appear. The big diameter of the pocket 41 provides—if simplified, a taper of the narrow angle 54 where the bearing faces meet. Thus, the bearing faces are pressed together in the direction of the normals 54 of the tangents 46 of FIG. 10. Actually, the meeting faces are narrow portions of a ball and of a hollow ball. But the Figure demonstrates their simplification to a taper. Because, as bigger the diameter 52 is made relative to the diameter "d" as more the meeting faces near the configuration of a cone and would finally be a circle line if both diameters would be made equal. Thus, the Figure shows that under the 3.66 times higher load than the rate of pressure in the cylinder the pivot portion of the piston shoe, 53, will bind or weld in the bearing bed of the piston 1 of FIG. 10 as a morse taper of the drilling machine tool will bind in the morse cone of the drilling machine shaft. Such setting of a taper into a cone is, however, done to prevent any movement of the taper in the hollow cone. Thus, instead of providing a smooth pivotal movement the pocket 41 of FIG. 10 actually provides a binding and prevents the pivotal movement of the piston shoe pivot portion 53 in the bed of piston 1.

The invention has clearly discovered this error of the former art and now provides the means to overcome the errors of the former art.

Figure 6:
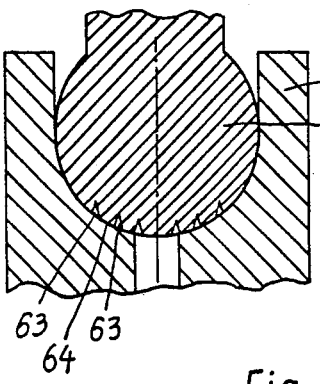
FIG. 6 is a cross-sectional view through an embodiment of the invention.
Figure 7:
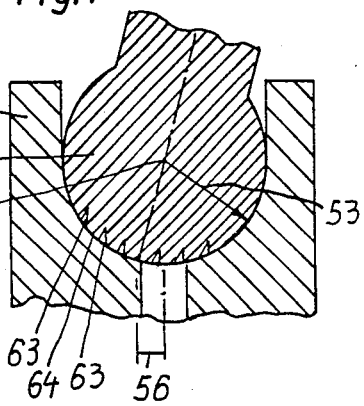
FIG. 7 is a cross-sectional view through an embodiment of the invention.
Figure 9:
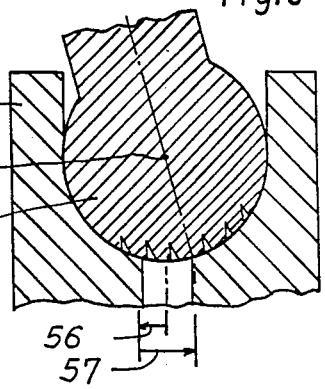
FIG. 9 is a cross-sectional view through an embodiment of the invention.

Consequently, FIGS. 6,7 and 9 show cross-sectional views through a pivot arrangement of the invention. The part cylindrical pivot portion 38 of the piston shoe is provided with very narrow recesses 63. Between two neighboring recesses 63 is a bearing land 64 provided. FIG. 6 shows the pivot portion in the neutral position. In FIG. 7 the pivot portion 38 is pivoted clockwise into the outermost clockwise position of the pivotal movement. The bottom line of the pivot portion has thereby travelled on the bearing bed the distance 56 of FIG. 7. Actually the length of the way of travel of the pivot face 5 on the pivot bed face 6 is the angle of pivotal movement multiplied by the radius 53 around the swing center axis 32 and multiplied by 2 times "pi". In FIG. 9 the pivot portion 38 has pivoted into a most counterclockwise location of the pivotal movement. During the travel from the position as in FIG. 7 to the position as in FIG. 9, the bottom line of the pivot portion has travelled the distance 57 as projected to the bottom in FIG. 9.

The rule of the present invention now is, that the length of the bearing lands 54 of the Figures, which means the distance between two neighboring recesses 63, shall be shorter than the distance 57 of FIG. 9 in order that each portion of the respective bearing land 54 travels through a portion of the pivot bed face 6 of the piston 1 which was just met and been run over a respective lubrication recess 63 of the pivot portion 38.

Figure 11:
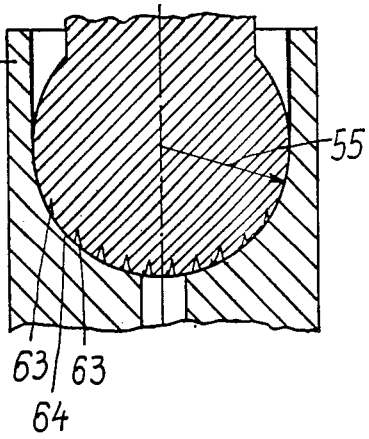
FIG. 11 is a cross-sectional view through a device of the invention.

FIG. 11 shows the similar situation of a pivot arrangement with partspherical faces. Since, in such a case, the piston walls can be held thinner than in part cylindrical pivot arrangements, the radius 55 of the pivot arrangement of FIG. 11 may be bigger than that of FIGS. 6, 7 and 9. Accordingly, it will be possible to set more recesses 63 and bearing lands 64 in FIG. 11.

Figure 14:
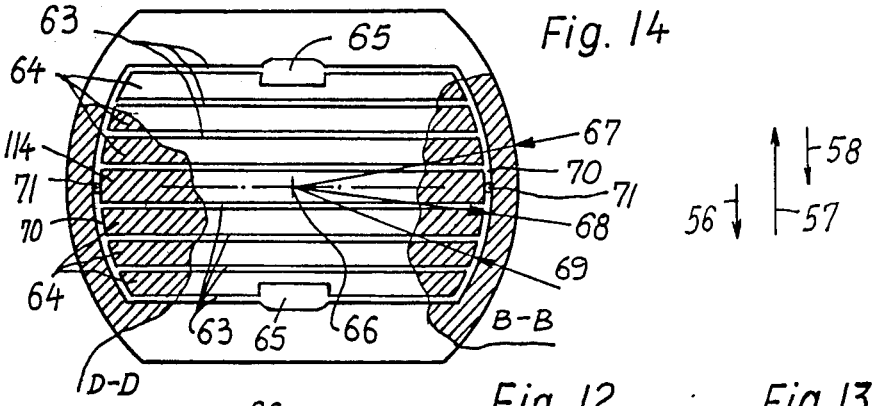
FIG. 14 is a view onto and through FIG. 12 along the lines B—B and D—D.
Figure 12:
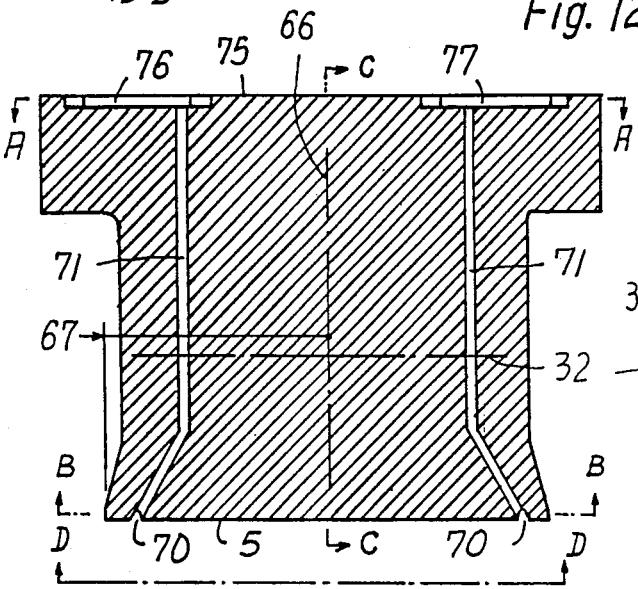
FIG. 12 is a longitudinal sectional view through a shoe of the invention.

Since it is not possible to draw the recesses 63 in Figures as narrow as they are made in actuality the pivotal piston shoe of FIGS. 6,7, and 9 is shown in FIGS. 12 to 15 in an enlarged scale. The recesses 33 of FIGS. 1 to 3 were commonly cast and had a width of a millimeter or maximally 1.5 millimeters in applicant's radial piston pumps or motors of 1980. FIG. 14 now shows, that the recesses are today smaller than they were during 1980. Thus, the pivot portion 38 of the stand of the invention of 1984 has very narrow recesses 63 which replace the recesses 33 of FIGS. 1 to 3. The recesses 63 are for very high pressure in fluid and they are not cast anymore but cut by sharp milling cutters of a width of a half a millimeter. By the narrowness of the receses 63 bigger sizes of area of bearing lands 64 are obtained compared to bearing lands 14 of FIGS. 1 to 3. Consequently, the shoe of FIGS. 12 to 15 is for still higher pressure in fluid than that of FIGS. 1 to 3. Where such high pressure is not required the shoes of FIGS. 1 to 3 are preferred because they are less expensive than the shoes of FIGS. 12 to 15. In any case, the shoes of FIGS. 1 to 3 as well as those of FIGS. 12 to 15 have a medial bearing land 114 arranged symmetrically around the longitudinal medial face 58 of the pivot portion. The bottom tip of the pivot portion is then the line 59 along the medial longitudinal plane of the pivot face 5 and this line is normal to the direction of the load when the piston shoe or pivot portion has its neutral position without pivoting in the bearing bed face 6 of the piston. FIG. 14 shows that the recesses 63, which now are real force-lubrication supply recesses but not fluid pressure pockets of the former art, end in the end recesss 70 which communicate all recesses 63 and 70. The piston shoe ends have the end radius 67 around the fourth axis, which is the vertical axis 66 of the piston shoe. The end recesses 70 are formed between the radii 68 and 69 around the fourth axis 66 to form sealing lands parallel to the outer radius 67. The piston shoe is also provided with the passages 71 to communicate the recesses 63 with the fluid pressure pockets 76,77 in the outer face 75 or slide face 75 of the piston shoe. The pivot face of the piston shoe may be provided with the control recesses 65 which communicate with recesses 63 and 70.

The outer face 75 of the piston shoe has the intersecting recesses 74 normal to the direction of running of the piston shoe and it may have bearing lands 78 between recesses 79 inside of the fluid pressure pockets 76 and 77. The recesses 79 and bearing lands 78 are then elongated in the direction normal to the direction of sliding of the piston shoe. The outcuts 72 and 73 are provided between the axial end portions of the shoe to make the long piston stroke possible as usual in Eickmann motors.

FIGS. 12 to 15 demonstrate in the gist of the present invention, that the piston shoe has an outer face 15 which forms a hydrostatic bearing with hydrostatic fluid pressure pockets 76,77 therein, while the pivot portion forms an overloaded bearing in the gist of the invention with force lubricating recesses and force lubricated bearing lands, 63 and 64.

Thereby it shall be demonstrated in accordance with the present invention, that the hydrostatic bearing and the overloaded bearing are very different matters with opposite effects of the recesses therein.

The slide face 75 has enough face area to provide fluid pressure pockets of such big sectional area that the fluid pressure pockets together with their surrounding sealing lands provide a hydrostatic bearing which can carry the load of the bottom of the piston. That means, that the area of the running face 75 with the fluid pressure pockets therein is bigger than the cross sectional area normal to the longitudinal axis of the piston. Or, in other words, the area of the slide face 75 with the pockets 76,77 therein is bigger than the area of the bottom of the piston. Since the mentioned area of face 74 with pockets 76,77 is bigger than the area of the bottom of the piston, this area can be made to a hydrostatic bearing with fluid pressure pockets and sealing lands.

The pivot faces 5, however, has an area of face which is in the projection along the longitudinal axis 3 of the piston 1 smaller than the area of the bottom of the piston. Since the area of the pivot face is smaller than the area of the bottom of the piston, it can not be made to a hydrostatic bearing. It is instead, in the gist of the present invention, an overloaded bearing or an overloaded face and requires for movement of the adjacent faces along each other the force lubrication of the provided bearing lands 64 by the lubrication recesses 63. The recesses 63 must be very short in the direction of movement of the pivot face. As shorter and thereby narrower the recesses 63 are as better the pivotal movement of the pivot portion will be secured. The bearing lands 64 and recesses 63 are provided to extend with their lengths, which is normal to their width, parallel to the third axis 32 and symmetrically around the medial bottom line 59 of the pivot portion.

Figure 15:
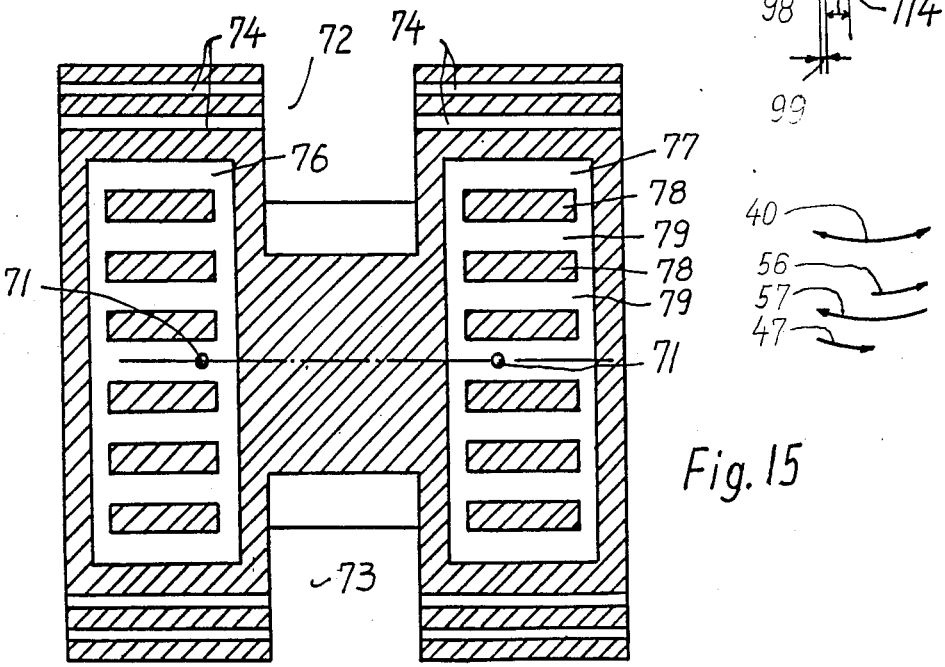
FIG. 15 is a sectional view through FIG. 12 along the line A—A therein.
Figure 18:
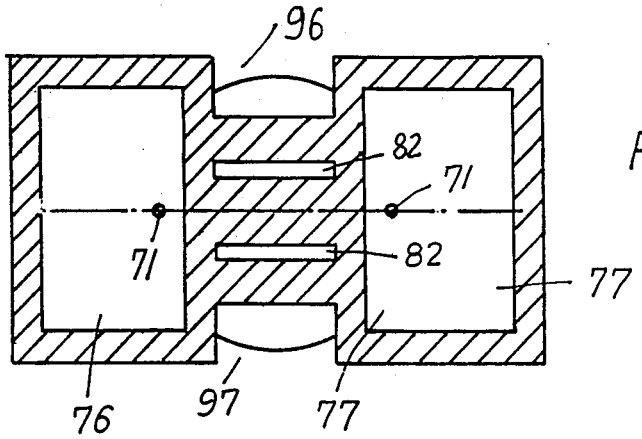
FIG. 18 is a sectional view through FIG. 16 along the line F—F therein.
Figure 16:
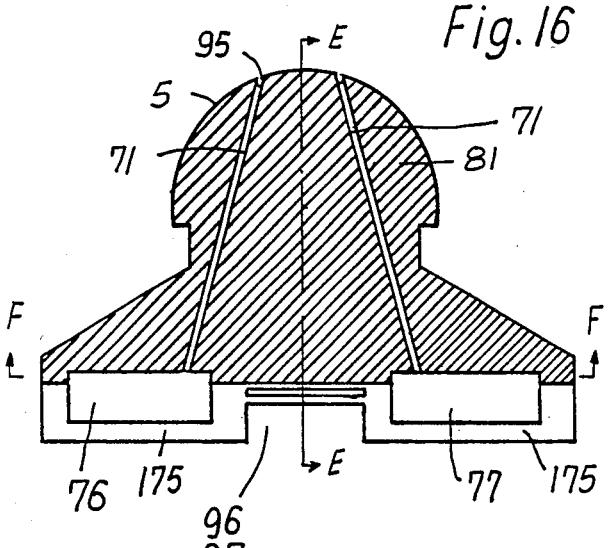
FIG. 16 is a longitudinal sectional view through a shoe of the invention.
Figure 17:
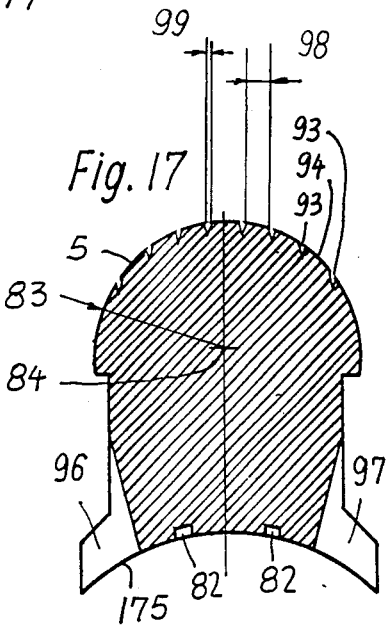
FIG. 17 is a cross sectional view through FIG. 16 along the line E—E.
Figure 19:
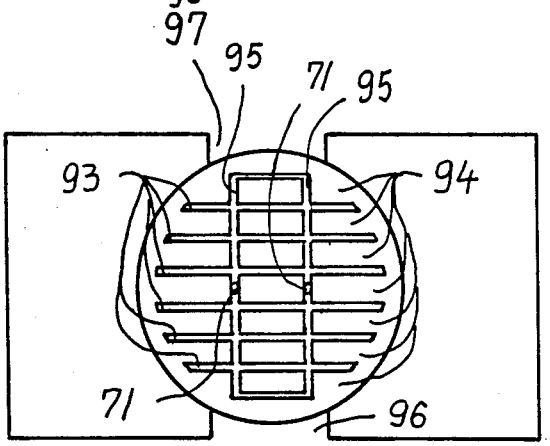
FIG. 19 is a view onto FIG. 16 seen along the arrow G.

The comparison of FIG. 14 with FIG. 15 directly shows the opposite provision of recesses in the hydrostatic bearing portion and in the overloaded portion of the same piston shoe. FIG. 14 shows the very narrow recesses 63 of very short width of the overloaded bearing, while FIG. 15 shows the wide dimensioned fluid pressure pockets 76,77 of the hydrostatic bearing. Thus, the pivot face of the shoe is an overloaded face in the gist of this invention, but the running face 75 of the same piston shoe is with its fluid pressure pockets a hydrostatic bearing. In the hydrostatic bearing the fluid enters by pressure drop into the clearance along the sealing lands. But in the overloaded bearing of face 5 or other overloaded faces or bearings, the fluid will not enter the clearances over the bearing lands by pressure drop from the recesses 63, because the clearance is practically non-existent since the adjacent faces which move along each other are pressed strongly together under the heavy overload which exceeds the rate of pressure in fluid in the force lubrication recesses 33 and 63. The difference between the hydrostatic bearings of the known art and the overloaded bearing of the invention is, that in the hydrostatic bearing the fluid pressure pockets are to be applied while in the overloaded bearing of the invention the very small but long force lubrication recesses 33 or 63 are to be applied and they are applied longitudinally normal to the direction of the movement and they must be so close together, that the bearing land between two neighboring force lubrication recesses 33,63 are shorter in the direction of the relative movement between the faces than the length of the movement of the one face along the other. Thus, the length of the bearing lands 14,114, 64 in the direction of the relative movement between the faces must be shorter than the length of the movement of the pivot face along the pivot bed face during the pivotal movement in one of the two pivotal directions.

The bearing lands 78 inside of the fluid pressure pocket of a hydrostatic bearing secure a better safety of operation, since the sealing lands are effected by the relative speed between the faces and by the temperature and viscosity of the fluid of the fluid pressure pockets. The bearing lands 78 of the hydrostatic bearings have thereby similar effects as in the overloaded bearing but they need no force lubrication since the load of the faces of hydrostatic bearings of the piston shoes are much smaller than the loads on the faces of the overloaded bearing of the piston shoe.

The critical value which decides whether the face can be used as a hydrostatic bearing with a fluid pressure pocket or whether it is an overloaded bearing or face which can not be changed to a hydrostatic bearing with fluid pressure pockets is the question, whether the area of the face is bigger or smaller than the cross sectional area of the bottom of the piston when equal rate of pressure in fluid is present at the bottom of the piston and in the fluid pressure pockets and in the force lubrication recesses.

In FIGS. 16 to 19 the therein shown piston shoe has the pivot bearing which is an overloaded bearing on the top, but the running bearing which is a hydrostatic bearing on the bottom of the shoe. The pivot portion 81 is a portion of a ball with a constant radius 83 around the center point 84. The configuration is thereby similar to that of FIG. 11 but oppositely directed. The force lubrication recesses 93 and the bearing lands 94 therebetween are to be elongated in the direction normal to the movement of the pivot face 5 while the recesses 93 have to be very narrow in the direction of the movement of the pivot face 5. This is known from the gist of the invention. To communicate the recesses 93 with each other the narrow communication recess or recesses 95 are provided. The shoe of these Figures also has the intersecting outcuts 96 and 97 to permit the guide faces on guide portions of the respective cylinders to enter temporarily into them to permit a great angle of pivotal movement and thereby in the gist of the Eickmann inventions, a long piston stroke, high efficiency and big power of the device. The running face 175 of the piston shoe is formed to be complementary to an eccentric cam with a cylindrical stroke guide face on a shaft of a pump or motor. The recesses 82 in the medial portion of the running face 175 are not communicated to fluid under pressure. They are intersecting recesses to prevent the appearance of unsecure zones when they run over portions of the stroke guide face of the shaft. The outcuts 96 and 97 are inclined inwardly towards the running face 175 because otherwise the respective guide faces and portions of the radial inwards extensions of the cylinders would prevent the high degree of pivotal movement and of the big angle of pivotal movement of the Eickmann motors and pumps.

It may be of interest that the devices of the present invention apply to deives with long piston strokes in radial piston devices, for example, those of the Eickmann U.S. Pat. Nos. 3,223,046; 3,297,834 and others. These devices require that the pivot portion is provided inside of the piston since otherwise the long piston stroke can not be obtained. Without the long piston strokes of the mentioned Eickmann patents, radial piston motors can never become powerful or effective in a small size and weight.

On the contrary thereto, piston pumps with outer piston shoes, as they appear also in the former art, the piston strokes are short and the pivot portion may be provided outwards of the cross-sectional area of the piston in addition to the use of the cross-sectional area of the piston. In such a case, the pivot bed and face can become large enough to permit a hydrostatic bearing with a fluid pressure pocket or pockets therein. But then the long piston strokes can not be obtained.

The narrowness of the recesses of the invention is a shortness in the direction of the pivotal movement of the pivot face along the bearing bed face and is shown in some of the Figures by 99. Similarly 98 defines the narrowness of the bearing lands of the invention and thereby their shortness in the direction of the mentioned pivotal movement.

Figure 13:
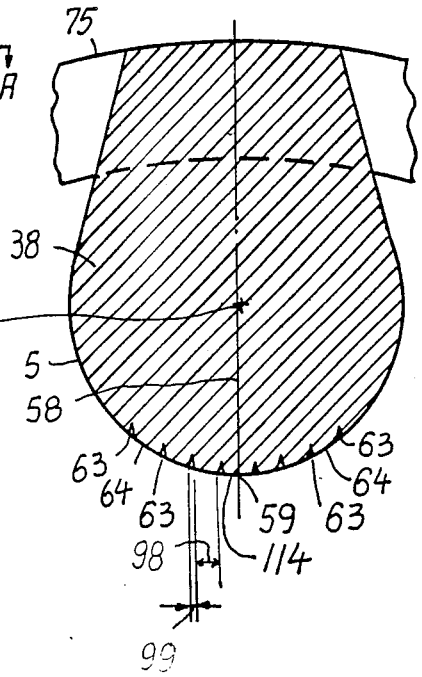
FIG. 13 is a sectional view through FIG. 12 along the line C—C therein.

The pivotal movement of the mentioned pivot face is shown by the movement of point or line 59 below FIG. 13 by the arrow 40 and the leftward step thereof is shown by 56, the next swing is shown by 57 and the return swing to the neutral position is shown by 47 below FIG. 13. The shortness of the recesses makes in the sum a great area of bearing lands possible whereby the rate of load on them can become restricted to remain below two times of the rate of pressure in the fluid in the recesses.

The prior art FIGS. 4 and 5 also explain, how, for example, the two bodies are assembled as piston and piston shoe into a portion of a radial piston device and how they act in relation to neighboring parts. The pistons and shoes of the other Figures may be assembled into similar devices. The piston stroke guide ring or piston stroke actuator is shown by referential number 100 and has the piston stroke guide face 101 whereon the outer face or slide faces 104 of the piston shoes slide. The stroke guide face 101 is formed with a constant radius around the eccentric axis 103 which is the axis of the stroke guide face 101 and/or of the stroke ring or actuator 100. The axis 103 is radially distanced by the eccentricity "e" from the concentric axis 102 which is the axis of the rotor 30 where around the rotor 30 revolves.

SUMMARY OF THE TECNOLOGIES INVOLVED

It was assumed in the prior art of the non-Eickmann patents that recesses in pivot portions with fluid therein would bring a floating of the pivot portion on the fluid film of a hydrostatic bearing. The recesses were assumed to be fluid pressure balancing securing recesses.

The present invention discovers that such a balancing of members by fluid pressure fields and pockets can be effective only in large faces of fluid field bearing abilities providing fluid bearings, but that these means can not be effective in overloaded slide bearings. According to the invention the pivot bearing of the invention is an overloaded bearing wherein the means of the mentioned other former art can not work as they were supposed to work. The difference between a fluid pressure bearing able fluid bearing and an overloaded bearing is according to this invention that a fluid pressure bearing able fluid bearing has a bearing face which is larger than the cross sectional area of a body on which an equal pressure in fluid acts in the opposed direction. The larger bearing face area permits the application of fluid pressure pockets of suitably large cross sectional area to be able to carry the counter directed load.

In an overloaded fluid pressure containing bearing, such as in the invention, the area of the bearing or pivot face is smaller than the cross sectional area of the body whereon the opposed force of pressure in fluid acts. Assumed is for both types of bearings that the pressures which act on the mentioned cross sectional area of the body and in the recesses or pockets are equal. That is the case because they are communicated with each other by respective passages.

Since the bearing face of the overloaded bearing is smaller than the mentioned fluid pressure loaded area of the respective body which opposes the direction of pressure in fluid in pockets or recesses in the bearing face of the overloaded bearing, the force which acts in the overloaded bearing is smaller than the force on the mentioned cross sectional area of the body, and, consequently, the fluid in the recesses or pockets of the overloaded bearing can not carry the opposed load and can, consequently, not provide a floating of a pivot portion or other portions on a fluid film or fluid bed of the bearing bed of the overloaded bearing. The consequence thereof is that recesses in overloaded bearings will result in reduction of the bearing face area and, consequently, result in such high relative load per area of bearing face that the bearing faces weld on each other.

In short, the fluid pressure recesses or pockets act in overloaded bearings differently and extremely opposed differently than they do on bearing able fluid bearings. While in bearing able fluid bearings the recesses and pockets act to carry the load and let the borne member float on them, the recesses or pockets in the overloaded bearings prevent a bearing of a member thereon and let the slide face or pivot face of the borne member weld on the bearing face. The recesses and pockets which assist and provide the bearing able fluid bearing do in fact in the overloaded bearing disturb the overloaded bearing, if no specific arrangements as such of the present invention are provided.

In radial fluid pressure devices the slide faces 104,75,175 etc. are capable of bearing able fluid bearings and act as such but the pivot beds, its face and the pivot portion with its pivot face of the invention are overloaded bearings and can not be other kind of bearings, whereby it is required to use the specific means of the present invention to prevent the welding of the faces on each other.

What is claimed is:

1. An assembly of a first body which comprises a piston and a thereon pivotable second body, wherein the first body has a first axis longitudinal through said first body, a part-cylindrical bearing bed face of substantially the form of about half of a hollow cylinder and formed with a first radius around a second axis which is normal to said first axis and extending through said first axis, a passage extends through said first body and through said bearing bed face while said passage is communicated to a space under high pressure in fluid, wherein said second body includes a pivot portion having a pivot face complementary formed to said bearing bed face and about 180 degrees with a second radius around a third axis, wherein said first and second radii are substantially equal and said pivot portion is borne with its pivot face on said bearing bed face and able to pivot thereon around said second and third axes while at said bearing of said pivot portion on said bearing bed face of said first body said third axis coincides substantially with said second axis, wherein said first body and second body are pressed towards each other by substantially oppositionally directed forces and said faces are at least partially lubricated by said fluid whereto said bearing bed face is communicated by said passage, wherein a plurality of recesses are provided into portions of one of said faces, said recesses are communicated to said passage and filled with fluid under pressure when said space whereto said passage is communicated contains fluid under pressure, and, wherein said recesses have a narrow width but a greater length and said recesses extend with their greater lengths in a direction parallel to said second and third axes whereby the remainders of said pivot face between said recesses form bearing lands between said recesses which extend parallel to said recesses and said second and third axes.

2. The assembly of claim 1;

wherein said bodies are pressed together by a pressurized fluid which acts on a cross sectional area of at least one of said bodies with said cross sectional area being larger than the projection of said bearing bed substantially in the direction from said bearing bed towards said cross sectional area, wherein said bearing lands and said bearing bed face at pivotal movements of said pivot face along said bearing bed face are subjected to drawing of fluid from said recesses;

wherein the pressure in said pressurized fluid is communicated to and equal to the pressure in said fluid in said recesses, wherein the breadth of said bearing lands is less than five millimeters and said recesses are closed on their longitudinal ends by pivot face portions of less than five millimeters in length in the direction parallel to said second and third axes, by which said bodies obtain an ability to pivot under high loads relative to each other, while said bearing lands tract fluid from said recesses along themselves and portions of said bearing bed face when said second body pivots relative to said first body.

3. An assembly of a first body which comprises a piston and a thereon pivotable second body, wherein said first body has a first axis longitudinal through said first body, a bearing bed face of a first radius around a center of a pivotal movement with said center meeting said first axis, said first body has a first area which is the cross-sectional area normal to said first axis and through said first body while said first area is subjected to pressure in fluid in a space with the direction of said pressure applied on said first body in the direction of said first axis towards said second body, a passage extends from said space through said first body and through said bearing bed face, wherein said second body includes a pivot portion with a pivot face complementary formed relative to said bearing bed face and with a second radius around a second center while said first and second centers coincide when said pivot face is set onto said bearing face, wherein the projection of said faces along said first axis defines a second area which is smaller than said first area by which said first and second bodies are pressed together on said faces towards each other under substantially opposed forces under said pressure in fluid whereto said first body with said first area is subjected, whereby a rate of relative load occurs per area of said faces which exceeds the rate of pressure per area in said fluid in said space;

wherein a plurality of recesses are provided into portions of one of said faces, said recesses are communicated to said passage and filled with fluid under pressure when said space whereto said passage is communicated contains fluid under pressure, and, wherein said recesses have a narrow width but a greater length and said recesses extend with their greater lengths in a direction parallel to said second and third axes whereby the remainders of said pivot face between said recesses form bearing lands between said recesses which extend parallel to said recesses and said second and third axes.

4. The arrangement of claim 3, wherein said bearing lands are in the direction of the pivotal movement of said second body in said first body shorter than the length of the movement of said pivot face along said bearing bed face during a single direction of said movement.

5. The device of claim 4, wherein the narrowness of said bearing lands secures the permanent renewal of movement of said bearing lands over immediately before said movement wetted portions of said bearing face in periodic cycles.

6. The device of claim 6, wherein said recesses are narrower than two millimeters and said bearing lands are narrower than five millimeters.

7. The device of claim 6, wherein the narrowness of said recesses secures a maximum of area of said bearing lands to limit said rate of relative load.

8. An assembly of a first body which comprises a piston and a thereon pivotable second body, wherein the first body has a first axis longitudinal through said first body, a part-cylindrical bearing bed face of substantially the form of about half of a hollow cylinder and formed with a first radius around a second axis which is normal to said first axis and extending through said first axis, a passage extends through said first body and through said bearing bed face while said passage is communicated to a space under high pressure in fluid, wherein said second body includes a pivot portion having a pivot face complementary formed to said bearing bed face and about 180 degrees with a second radius around a third axis, wherein said first and second radii are substantially equal and said pivot portion is borne with its pivot face on said bearing bed face and able to pivot thereon around said second and third axes while at said bearing of said pivot portion on said bearing bed face of said first body said third axis coincides substantially with said second axis, wherein said first body and second body are pressed towards each other by substantially oppositionally directed forces and said faces are at least partially lubricated by said fluid whereto said bearing bed face is communicated by said passage, wherein a plurality of recesses are provided into portions of one of said faces, said recesses are communicated to said passage and filled with fluid under pressure when said space whereto said passage is communicated contains fluid under pressure, wherein said recesses have a narrow width but a greater length and said recesses extend with their greater lengths in a direction parallel to said second and third axes whereby the remainders of said pivot face between said recesses form bearing lands between said recesses which extend parallel to said recesses and said second and third axes, wherein said bodies are pressed together by a pressurized fluid which acts on a cross sectional area of at least one of said bodies with said cross sectional area being larger than the projection of said bearing bed substantially in the direction from said bearing bed towards said cross sectional area, wherein said bearing lands and said bearing bed face at pivotal movements of said pivot face along said bearing bed face are subjected to drawing of fluid from said recesses;

wherein the pressure in said pressurized fluid is communicated to and equal to the pressure in said fluid in said recesses, wherein the breadth of said bearing lands is less than five millimeters and said recesses are closed on their longitudinal ends by pivot face portions of less than five millimeters in length in the direction parallel to said second and third axes, by which said bodies obtain an ability to pivot under high loads relative to each other, while said bearing lands tract fluid from said recesses along themselves and portions of said bearing bed face when said second body pivots relative to said first body, and, wherein said second body is a piston shoe and said space is a cylinder of a radial piston machine having a plurality of pistons, piston shoes and cylinders, wherein fluid flows through said cylinders of said machine and said piston shoes pivot relative to said pistons when said machine works under power.

9. The assembly of claim 8, wherein said pivot portion of said piston shoe has part cylindrical ends which are distanced from each other with a distance which is slightly less than the diameter of the outer face of the respective piston and wherein one of said bearing lands is provided in the middle of the bottom of the pivot portion of the piston shoe equally dimensioned along the vertical medial plane through the piston shoe and said recesses are symmetrically arranged around said medial vertical plane through said piston shoe.

10. A radial piston device of the type wherein a piston reciprocates in a cylinder and a piston shoe is pivotably borne in said piston while said piston shoe has a slide face to slide along a piston stroke guide face arrangement and wherein said slide face is provided on an external portion of said piston shoe which extends beyond the outer diameter of said piston and forms guide portions to be guided on said stroke guide face arrangement while said piston shoe has a vertical axis which defines a thereto normal directed cross-sectional piston shoe pivot portion area which is smaller than the cross-sectional area through said piston to permit the location of said pivot portion of said shoe within said piston, wherein said cylinder is provided with a pressurized fluid of a first rate of pressure per area and said piston is subjected with its cross sectional area to said fluid in said cylinder whereby said pressure provides a first load on the bottom of said piston equal to said rate of pressure multiplied by said cross-sectional area of said piston, wherein said piston forms a bearing bed face of a radius around a center of pivotal movement with said center meeting said first axis, wherein said pivot portion of said piston shoe forms a pivot face around said center of said pivotal movement with a radius equal to said radius of said bed to pivot with said pivot face along said bearing bed face to carry out sald pivotal movement, wherein the projection of said faces in the direction of said first axis defines a second area which is smaller than said cross sectional area of said piston while said pressure in said fluid presses said faces together with a second rate of pressure per area which exceeds said rate of pressure in said fluid and whereby said faces are pressed strongly together to meet each other with said second rate of pressure which exceeds said first rate of pressure;

wherein a passage extends from said cylinder through said piston and said bearing bed face towards said piston shoe and said pivot portion thereof;

wherein a plurality of recesses are provided into portions of one of said faces, said recesses are communicated to said passage and filled with fluid under pressure when said cylinder whereto said passage is communicated contains fluid under pressure, and, wherein said recesses have a narrow width but a greater length and said recesses extend with their greater lengths in a direction which is normal to the directions of said pivotal movement whereby the remainders of said pivot face between said recesses form bearing lands between said recesses which extend parallel to said recesses, while said recesses are shorter in said direction of said pivotal movement relative to said bearing lands between said recesses.

* * * * *